United States Patent [19]

Finger

[11] Patent Number: 4,497,583

[45] **Date of Patent: * Feb. 5, 1985**

[54] FLUID-TIGHT WATCH CASE WITH U-SHAPED BEZEL

[75] Inventor: Hansjörg Finger, Lengnau, Switzerland

[73] Assignee: Firma H. Finger, Berne, Switzerland

[ * ] Notice: The portion of the term of this patent subsequent to Dec. 14, 1999 has been disclaimed.

[21] Appl. No.: 398,580

[22] Filed: Jul. 15, 1982

Related U.S. Application Data

[62] Division of Ser. No. 151,826, May 21, 1980, Pat. No. 4,363,555.

[30] Foreign Application Priority Data

May 30, 1979 [CH] Switzerland ..... 5041/79

[51] Int. Cl.[3] ..... G04B 37/00

[52] U.S. Cl. ..... 368/291; 368/292

[58] Field of Search ..... 368/276, 88, 291, 292, 368/294, 295, 309, 311, 286, 283

[56] References Cited

U.S. PATENT DOCUMENTS 4,197,698 4/1980 Finger ..... 368/291

4,363,555 12/1982 Finger ..... 368/291

*Primary Examiner*—Bernard Roskoski

*Attorney, Agent, or Firm*—Parkhurst & Oliff

[57] ABSTRACT

A bezel (6) is composed of two parts (12 and 13) which may be formed by machining and are thereafter joined to one another by welding, soldering, brazing, or cementing. A peripheral rib (14) of a wall (2) of the case back (1) extends within the U-shaped profile formed by the two bezel parts (12 and 13). The rib (14) surrounds a gasket (15) fitted on the inner arm (13*a*) of the U-shaped profile (12, 13), the outward face of which being frustoconical and flaring downwards, for holding the gasket in place, thus facilitating assembly.

4 Claims, 4 Drawing Figures

FLUID-TIGHT WATCH CASE WITH U-SHAPED BEZEL

This is a division of application Ser. No. 151,826 filed May 21, 1980, now U.S. Pat. No. 4,363,555.

BACKGROUND OF THE INVENTION

This invention relates to watch cases, and more particularly to a fluid-tight watch case of the type intended to contain a watch movement and a dial fixed to the movement, comprising a back including a peripheral wall, a bezel surrounding this wall, being removably attached thereto and including a holding element intended to keep the dial and the movement in place, a glass made of mineral material supported by the bezel, and an annular gasket compressed between the bezel and the peripheral wall of the back.

The current tendency to make increasingly thinner fluid-tight watches entails the production of watch cases made up of simplified components, which can easily be secured to one another, and provided with means for ensuring fluid-tightness and fastening means which are both as compact as possible.

In general, such watch cases may be round or non-round, and the glasses utilized are plane and made of a transparent mineral material such as mineral glass, or of a stone such as sapphire. Great care must be taken in fixing the glass to the bezel; and in most cases, in order to ensure fluid-tightness, a flat gasket is inserted between the periphery of the glass and the walls of the annular groove, called the snap, provided in the bezel for receiving the glass.

DESCRIPTION OF THE ART

The published U.K. Specification No. 2,012,458 A describes a watch case of the type initially mentioned wherein the bezel is in one piece and the gasket is disposed in an undercut in the peripheral wall of the back. This prior art design has made it possible to produce thinner watch cases than ever before. However, it has its limitations owing to the lessened rigidity of the bezel, for it has been found that if the thickness of the bezel is reduced beyond certain limits, the metals commonly used for the bezel no longer guarantee sufficient rigidity, the diameter of the watch having to remain the usual size in any event.

Thus, there is a need for a watch case in which this difficulty is overcome by means of a design which makes it possible to reduce the thickness of watch cases still further without appreciably lessening the rigidity of the component parts.

Watch case designs have been proposed in which the underside of the bezel includes a groove for receiving a gasket. Bezels of this kind are described in Swiss Pat. Nos. 443,158 and 386,934. However, these are round watch cases, and they are not designed for achieving extreme thinness. Hence these prior art designs do not suggest any solution to the problem set forth above.

SUMMARY OF THE INVENTION

In the watch case according to the present invention, of the type initially mentioned, the bezel is an annular part of U-shaped cross-section having an inner arm and an outer arm bounding between them an annular groove, the gasket being accommodated within this groove, the outer arm of the bezel including means for fixing the bezel to the back, and the inner arm exhibiting the holding element at its free end, whereby said gasket is situated at a level between the intended location of said dial and the glass.

In a particularly advantageous embodiment of the invention suitable for non-round watches, e.g., square or rectangular watches, watches having rounded corners, etc., the bezel is made up of two parts rigidly fixed to one another.

BRIEF DESCRIPTION OF THE DRAWINGS

Several preferred embodiments of the invention will now be described in detail with reference to the accompanying drawings, in which.

DETAILED DESCRIPTION OF THE INVENTION

Figure 1:
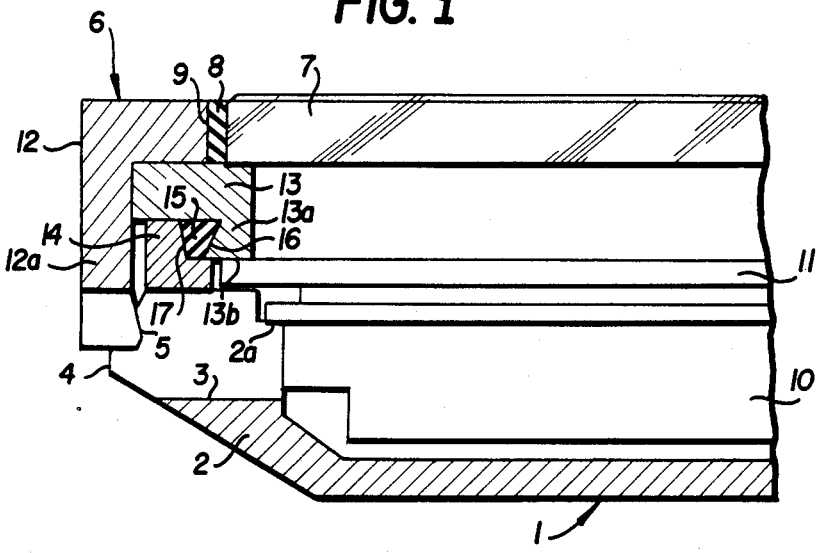
FIGS. 1 and 2 are partial axial sections passing through the axis of the stem hole and respectively showing two embodiments of the watch case according to the invention.

All the embodiments illustrated include a domed back 1 having a peripheral wall 2. At the location corresponding to 3 o'clock, a cylindrical hole 3 passes through the wall 2 for accommodating a stem. The wall 2 further includes a rim 4 and a snap 5 into which a bezel 6 is hooked. The bezel 6 supports a glass 7 which is plane piece of mineral glass or sapphire fixed by means of a gasket 8 in an undercut 9 of the bezel 6.

The watch case may be round or non-round. The means for attaching the watchband are not shown; they may be horns, loops, or lugs placed on opposite sides of the case, projecting either from the wall 2 of the back 1 or from the bezel 6.

Situated above a watch movement 10 accommodated in the watch case is a dial 11. The movement 10 is held in place within the back 1 by an inner arm 13*a* of the bezel 6 pressing upon the margin of the dial 11. Thus, the underside 13*b* of the arm 13*a* forms a holding element for the dial 11.

In each of the embodiments illustrated, the bezel 6 is made up of two parts 12 and 13. The outer part 12 may bear the horns of the watch case, as mentioned above, and has an L-shaped cross-section. The part 13, also having an L-shaped cross-section, extends in height from the dial 11 to the underside of the glass 7. It is this part of the bezel that holds the dial 11 and, consequently, the movement 10 in place within the watch case. The movement 10 is kept pressed against a shoulder 2*a* of the wall 2 of the back 1 by a plate fillet.

Figure 2:
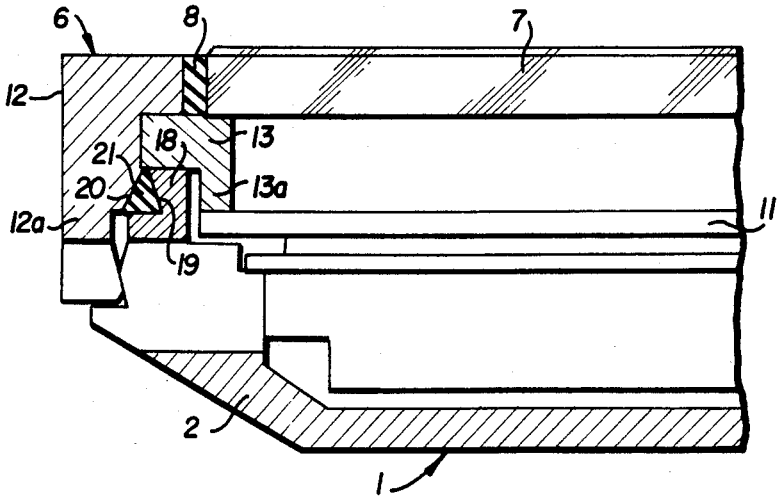

In the first embodiment, the parts 12 and 13 are joined so that together they form an annular part having an inverted-U-shaped cross-section, the space between the two arms 12*a* and 13*a* being sufficient to accommodate a rib 14, forming the top of the wall 2, and a gasket 15. As may be seen in FIG. 1, the rib 14 surrounds the gasket 15, which is an O-ring fitted about the inner arm 13*a* of the bezel 6. The arm 13*a* is bounded by an oblique face 16 which flares out downwards so that it holds the gasket 15 captive during the preparations for assembly. As can be seen in FIGS. 1 and 2, rib 14 of wall 2 extends between the outer and inner arms 12 and 13 of the bezel.

During manufacture, after machining of the parts 12 and 13, they will be joined in such a way that the glass-snap 9 is formed at the top of the inner arm 13*a*. The parts 12 and 13 may be joined by cementing, brazing, soldering, or spot-welding. When preparations are being made for assembly, the gasket 15 will be fitted on the arm 13*a*. Thereafter it, will be handled together with the bezel and is not liable to get lost.

The rib 14 is bounded towards the inside by an oblique annular surface 17 which flares out upwards and against which the gasket 15 will press when the watch case is closed. The joining of the bezel parts by welding or cementing suffices to make the bezel 6 very rigid owing to its U-shaped cross-section, whereas the effects of mass are reduced since the cross-section is hollowed.

In this way, a case design is provided which can be applied to all shapes and which is suitable for accommodating extremely thin watch movements such as the electronic movements of reduced thickness having hands, which have recently appeared on the market. Because the gasket 15 is situated at a level between that of the dial 11 and that of the glass 7, the stem hole 3 can be situated just beneath the rib 14. The rib 14 also reinforces the wall 2 of the back 1; and as the bezel 6 is itself very rigid, although of reduced weight, the result is a fluid-tight watch combining high reliability with reduced thickness. In a reduction to practice intended for a watch movement 2.5 mm thick, the total thickness of the case does not exceed 6.4 mm.

In the second embodiment (FIG. 2), the same elements are to be found, only certain details being different. Thus, the wall 2 of the back 1 is provided along its upper edge with a rib 18, the outer face 19 of which is oblique and flares upwards. Furthermore, the part 12 of the bezel 6, rather than the part 13, is machined with an oblique surface 20 flaring downwards and intended to press against a gasket 21. This gasket will therefore be fitted about the rib 18 of the back 1 prior to casing up. During this latter operation, the inner arm 13*a* of the bezel 6 will press against the dial 11.

Here, too, the two parts composing the bezel 6 may be fixed to one another by any of the means mentioned above, and the height of the part 13 determines the space between the dial 11 and the glass 7.

The gasket 8 ensures fluid-tightness between the glass 7 and the part 12. Moreover, the gasket 21 ensures fluid-tightness between the bezel 6 and the back 1. Hence it is not indispensable that there be a perfectly fluid-tight joint between the parts 12 and 13. A few spots of welding will suffice.

In FIG. 1, the outer arm of the bezel is partly spaced from the peripheral wall, while the gasket 16 is held between the inner arm and the peripheral wall. In FIG. 2, the inner arm is spaced from the peripheral wall, while the gasket is held between the outer arm and the peripheral wall.

In these first two embodiments, the engagement of the arm 12*a* and the snap 5 tends to pull the bezel 6 downwards, compressing the gasket 15 or 21. The flat bottom of the cross-section of the bezel 6 presses against the top of the rib 14 or 18.

Figure 3:
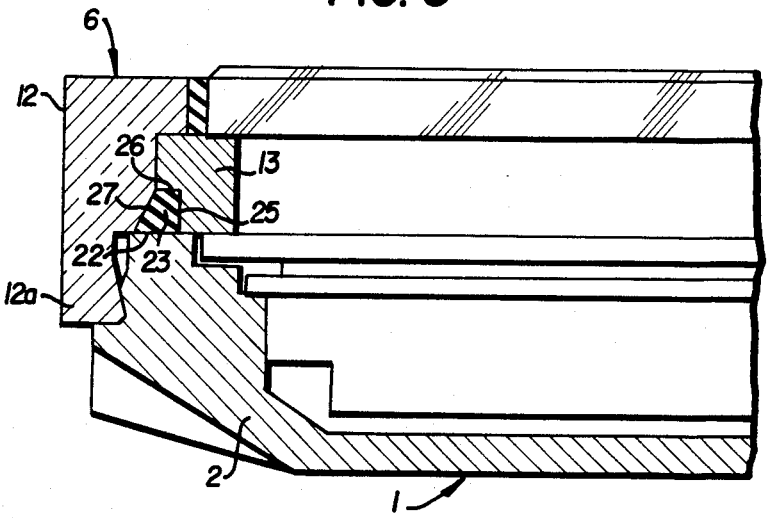
FIGS. 3 and 4 are partial axial sections taken at an angle to the axis of the stem hole and showing two further embodiments.
Figure 4:
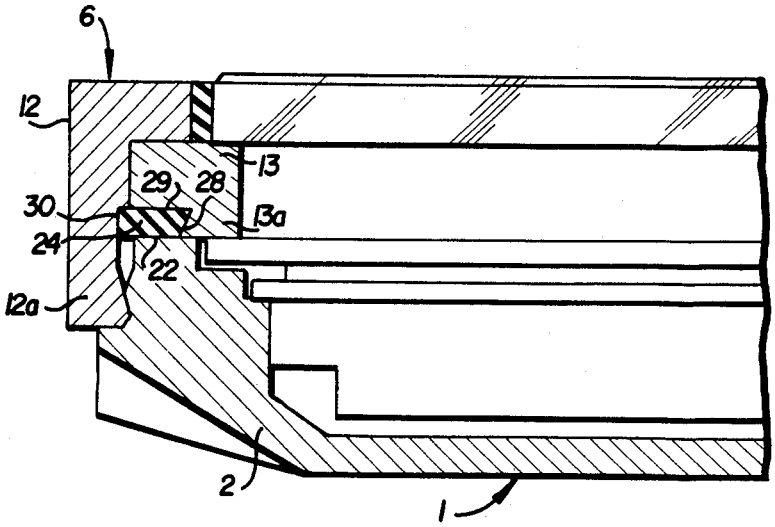

In the embodiments illustrated in FIGS. 3 and 4, the wall 2 of the back 1 is bounded at the top by a plane annular surface 22. The bezel 6 is composed of two L-profile parts 12 and 13 which together form an inverted U-shaped cross-section, the bottom of which is occupied, in the case of FIG. 3, by a gasket 23, which may be a toroidal gasket, and in the case of FIG. 4, by a gasket 24, e.g., a flat gasket.

In FIG. 3, the inner groove of the bezel 6 is bounded by a cylindrical face 25 belonging to the part 13, by a plane face 26 which forms the bottom of the U-shaped cross-section, and by a downwardly flaring face 27 which bounds the part 12. The faces 25, 26, and 27 delimit a groove of trapezoidal cross-section which is completely filled by the gasket 23.

Similarly, in the embodiment of FIG. 4, the gasket 24, although flat, is completely contained within a groove of trapezoidal cross-section bounded by a face 28 of the arm 13*a* which flares downwards, by a plane face 29 which forms the bottom of the cross-section, and by an outer side face 30 of the part 12. The flat gasket 24 is therefore pressed against the plane surface 22 when the bezel 6 is fitted in the snap 5 of the back 1.

In these latter two embodiments, the gasket 23 or 24 is pressed against the plane surface 22 which forms the top plane of the wall 2. This same plane surface 22 supports shoulders of the bezel 6.

The design described makes it possible to achieve a reduction in height never before attained, owing to the fact that the gasket is disposed at a higher level than the dial, in other words, within the flange or between the underside of the glass and the dial. The two parts making up the bezel can be machined with very high precision, so that after being joined, they form a high-quality component, very light and rigid, capable of ensuring the fluid-tight closure of the watch case. Because of the rigidity of this component and its resistance to deformation, this part can be very easily manipulated, so that assembly rejects caused by deformations of the parts need not be feared.

If need be, the bezel 6 might be made in one piece. However, it has been found that producing it in two welded or cemented pieces presents obvious advantages. In particular, the inner flanks of the U-shaped cross-section can be machined with very great precision, which contributes towards obtaining good fluid-tightness. The two parts can be machined separately, after which the joining operation takes place.

The main advantage of the design described is that it allows the production of extremely thin watch cases, of non-round shape, which are very attractive and exhibit good fluid-tightness.

Secondly, the fact that the gasket is fitted within the profile of the bezel about the inner arm of this profile, as in the embodiments of FIGS. 1 and 4, is also an important advantage from the point of view of handling and of servicing.

Finally, the welded or cemented design allows the production of rigid, precision-machined, non-round bezels, which may be made of two different metals.

I claim:

1. A fluid tight watch, comprising:

a case;

a movement;

a dial fixed to said movement, said movement and said dial being contained in said case;

said case comprising:

a back having a peripheral wall which surrounds said movement and extends to a level at least as high as said dial;

a glass;

a bezel; and an annular gasket;

wherein said bezel comprises a first annular part of L-shaped cross section having a first axially-directed arm and a first radially directed arm, said first axially-directed arm extending around and outside said peripheral wall, said first radially-directed arm extending radially inwardly, with said glass being fitted to said first radially-directed arm; said bezel further comprising a second part of L-shaped cross section having a second axially-directed arm and a second radially-directed arm, said second axially-directed arm extending from said glass to said dial within said peripheral wall, said second radially-directed arm extending outwardly beneath said first radially-directed arm, each of said first and second parts of said bezel comprising at least one contacting surface which is joined to the contacting surface of the other part of said bezel by cementing, brazing, soldering or welding, said first axially-directed arm comprising means for engaging said peripheral wall, said gasket being disposed between said first and second axially-extending arms and compressed against said peripheral wall, said gasket being disposed at a level between the level of said dial and the level of said glass.

2. A fluid tight watch as claimed in claim 1, wherein aid gasket engages said second axially-directed arm.

3. A fluid-tight watch, comprising:

a case;

a movement;

a dial fixed to said movement, said movement and said dial being contained in said case;

said case comprising:

a back having a peripheral wall;

an annular bezel removably attached to said peripheral wall of said back, and substantially U-shaped in cross section, said annular bezel composed of two pieces of L-shaped cross section rigidly joined to one another by cementing, brazing, soldering or welding, said U-shaped cross section having an inner arm, an outer arm and an annular groove bounded by said inner arm and said outer arm, said inner arm being disposed radially inwardly of said peripheral wall and being radially spaced from said peripheral wall, said peripheral wall extending between said inner arm and said outer wall;

said inner arm comprising holding means at the free end of said inner arm for keeping said movement and said dial in place;

a glass supported by said bezel; and an annular gasket disposed at a level between the level of said dial and the level of said glass, said gasket being located within said groove and compressed between said peripheral wall and said outer arm.

4. A watch case in accordance with claim 3, wherein said outer arm has an inner face inclinded obliquely and pressing against said gasket, said inner face flaring downards, and said gasket being fitted about said annular rib.

* * * * *